United States Patent [19]

Compagnucci

[11] Patent Number: 4,913,298

[45] Date of Patent: Apr. 3, 1990

[54] EXTRACTABLE CARRIAGE FOR KITCHEN UNITS

[76] Inventor: Rossano Compagnucci, Via Flaminia 11, Osimo (AN), Italy

[21] Appl. No.: 393,101

[22] Filed: Aug. 3, 1989

Related U.S. Application Data

[63] Continuation of Ser. No. 201,848, Jun. 3, 1988, abandoned.

[30] Foreign Application Priority Data

Oct. 19, 1987 [IT] Italy ..... 17933 A/87

[51] Int. Cl.[4] ..... A47F 5/00

[52] U.S. Cl. ..... 211/162; 211/94

[58] Field of Search ..... 211/162, 94, 126, 151, 211/182, 195, 132, 133; 312/258; 403/290

[56] References Cited

U.S. PATENT DOCUMENTS

| | | | |
|---|---|---|---|
| 1,235,248 | 7/1917 | Sabel | 211/132 |
| 1,826,432 | 10/1931 | Owen | 403/290 |
| 2,622,541 | 12/1952 | Smart | 211/162 X |
| 2,871,861 | 2/1959 | Posner | 211/162 |
| 2,956,763 | 10/1960 | D'Arca | 211/195 X |
| 3,069,020 | 12/1962 | Sans | 211/162 |
| 3,243,165 | 3/1966 | DeWoody et al. | 403/290 X |
| 3,321,261 | 5/1967 | Guth | 211/162 X |
| 3,367,727 | 2/1968 | Ward et al. | 403/290 X |
| 3,394,819 | 7/1968 | Saville | 211/126 |
| 3,670,899 | 6/1972 | Kronenberg et al. | 211/182 |
| 3,726,522 | 4/1973 | Silberman | 403/290 X |
| 4,139,101 | 2/1979 | Towfigh | 211/182 X |
| 4,524,484 | 6/1985 | Graham | 403/290 X |
| 4,621,878 | 11/1986 | Johnson et al. | 312/258 X |
| 4,623,066 | 11/1986 | Talbot | 211/195 |
| 4,632,473 | 12/1986 | Smith | 211/182 X |
| 4,637,177 | 1/1987 | Long | 312/258 X |
| 4,642,837 | 2/1987 | Nichols et al. | 403/290 X |
| 4,694,544 | 9/1987 | Chapman | 403/290 X |

FOREIGN PATENT DOCUMENTS

| | | | |
|---|---|---|---|
| 6508781 | 1/1966 | Netherlands | 211/162 |
| 819855 | 9/1959 | United Kingdom | 211/126 |

*Primary Examiner*—Alvin C. Chin-Shue
*Assistant Examiner*—Sarah A. Lechok
*Attorney, Agent, or Firm*—Leonard Bloom

[57] ABSTRACT

This invention concerns an extractable carriage for kitchen units made from modular components coupled together in a simple and rapid fashion and going to make up carriages which may differ in width while their height and length remain unaltered.

The extractable carriage according to the invention is characterized by the fact that it is composed of two tracks with no transversal connection; likewise, the two U-shaped lateral supporting frames are separate items in that there is no connection between their uprights until assembly, and then only by means of the trays that are directly attached to them.

7 Claims, 2 Drawing Sheets

51
5a
50

5b 50
53
52
51
52
5a 5b
5b 35
3a
3
3b
30
33
31
34

32

3b

EXTRACTABLE CARRIAGE FOR KITCHEN UNITS

This application is a continuation, of application Ser. No. 201,848, filed June 3, 1988, now abandoned.

DISCLOSURE

This patent application for an industrial design concerns an extractable carriage for kitchen units made from modular components coupled together in a simple and rapid fashion and going to make up carriages which may differ in width while their height and length remain unaltered.

This feature derives from the fact that, for the first time, transversal connecting supports are not provided between the two tracks within which the carriage runs, or between the four uprights of the actual carriage, said uprights, arranged in pairs, are an integral part of a couple of identical opposing U-shaped lateral supporting frames, connected to one another only by the trays hooked thereupon.

It is immediately obvious that, using the same pair of longitudinal tracks and the same pair of lateral supporting frames, it is possible to obtain extractable carriages of differing widths by simply mounting and securing, between the two aforementioned frames, trays of differing widths.

Said U-shaped supporting frames, composed of two upright pieces and a counter-rail along the bottom, are supplied to the user preassembled so as to simplify carriage assembly which is reduced to simply attaching the various trays to the uprights of the two lateral frames and screwing the two longitudinal tracks onto the bottom of the kitchen units in which the extractable carriage is to be installed.

In order to reduce the amount of space required by said supporting frames during transportation from the manufacturer to the user and during storage, the uprights are screwed to either end of the counter-rail with just one screw; thus once the screw has been loosened they can be rapidly rotated through 90° towards one another so that they lie over and against the bottom counter-rail, with the result that the overall dimensions of said frames when packed are determined only by the longitudinal dimensions of said bottom counter-rail, the transversal dimensions thereof being extremely small, in the region of about one or two centimetres.

In order to ensure that, when positioned vertically, the uprights remain stable, and bearing in mind that they are attached to the bottom counter-rail by means of just one screw, a pair of adjacent pins are provided at both ends of the counter-rail, one of each pair being intended to fit exactly into a corresponding hole provided for this purpose at the lower end of each upright and the other into the slot along which the aforesaid anchoring screw slides.

The anchoring of the various trays to the two lateral supporting frames is effected by means of a connecting element moulded in plastic and conceived precisely for the extractable carriage according to the invention, consisting of a hollow screw which, using slight force, may be pushed over the end of the round metal cross-piece that goes to make up the transversal edge of the tray, the latter being in the form of a grille.

The securing of said tray to the lateral supporting frames is effected by pushing said screw as far as it will go, from the inner side of the upright towards the outer side, through a set of holes provided for this purpose on the uprights, and then tightening said screw with a nut which will lie against the outer face of the upright.

The versatility, together with the rapidity and simplicity of assembly of the various structural components of the extractable carriage for kitchen units according to the invention, cannot certainly pass unobserved by operators in the sector accustomed to a market that offers the user extractable carriages of differing formats, each one already completely assembled by its respective manufacturer, secured and mounted using means and techniques that could certainly not be assigned to the user as they require specific equipment and specialised labour.

The extractable carriage according to the invention, however, because it is so simple to assemble, can even be sold in pieces, in the same way that single components could be sold as spare parts to replace those accidentally damaged or broken.

Finally, attention should be paid to the small amount of space occupied by the carriage according to the invention when its components are not assembled; the trays, usually in groups of three, can in fact be stacked one inside the other, while the pair of supporting and guiding tracks for the carriage and the pair of portable lateral frames, in the folded position, can be placed inside the uppermost tray in the stack, since the diagonal measurements of a tray are greater than the length of the tracks and the upright of said supporting frames.

In other words, all the components of the extractable carriage according to the invention can fit into a package with a flat area equal to that of a tray, and a height equal to three trays stacked one inside the other.

For greater clarity of explanation, the description continues with reference to the enclosed drawings, included for illustrative and not limitative purposes, wherein.

Figure 1:
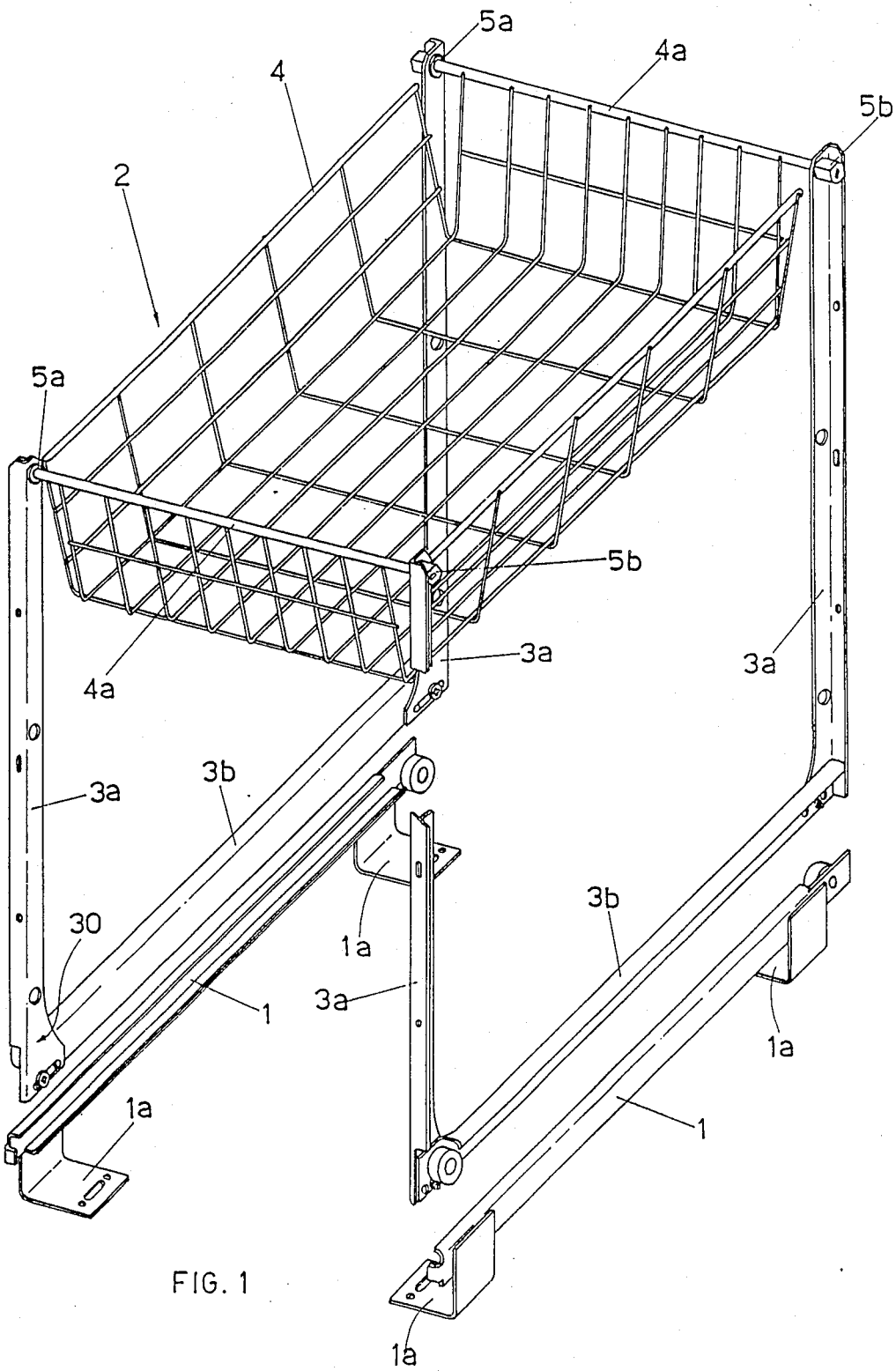
FIG. 1 is an exploded perspective drawing of the extractable carriage according to the invention, detached from the two supporting and guiding tracks which are, however, illustrated in the diagram.

With reference to the abovementioned diagrams, the extractable carriage according to the invention includes:

(a) two supporting and guiding tracks (1) for the carriage (2), with no transversal connection, each track being equipped with a pair of brackets (1*a*) bearing holes suitable for attaching the tracks (1) to the bottom of the unit in which the carriage (2) is to be installed; the shape of each track and the dislocation of the wheels therein are of the standard type;

(b) two lateral supporting frames (3), each one made up of two identical symmetrical uprights (3*a*), screwed at the bottom to the inner side of either end of a counter-rail (3*b*) of standard conformation that is able to partially fit into and slide along one of the two tracks (1);

(c) trays or surfaces in the form of grilles (4) characterised by the fact that they possess, on their two transversal sides, a rounded metal edge (4*a*);

(d) securing devices (5) for anchoring the trays (4) to the uprights (3*a*) of the lateral supporting frames (3), said devIces being composed of a hollow screw (5*a*) and a nut (5*b*) that screws onto the former(5*a*).

Figures 2, 3, 4, 5, 6, 7, 8:
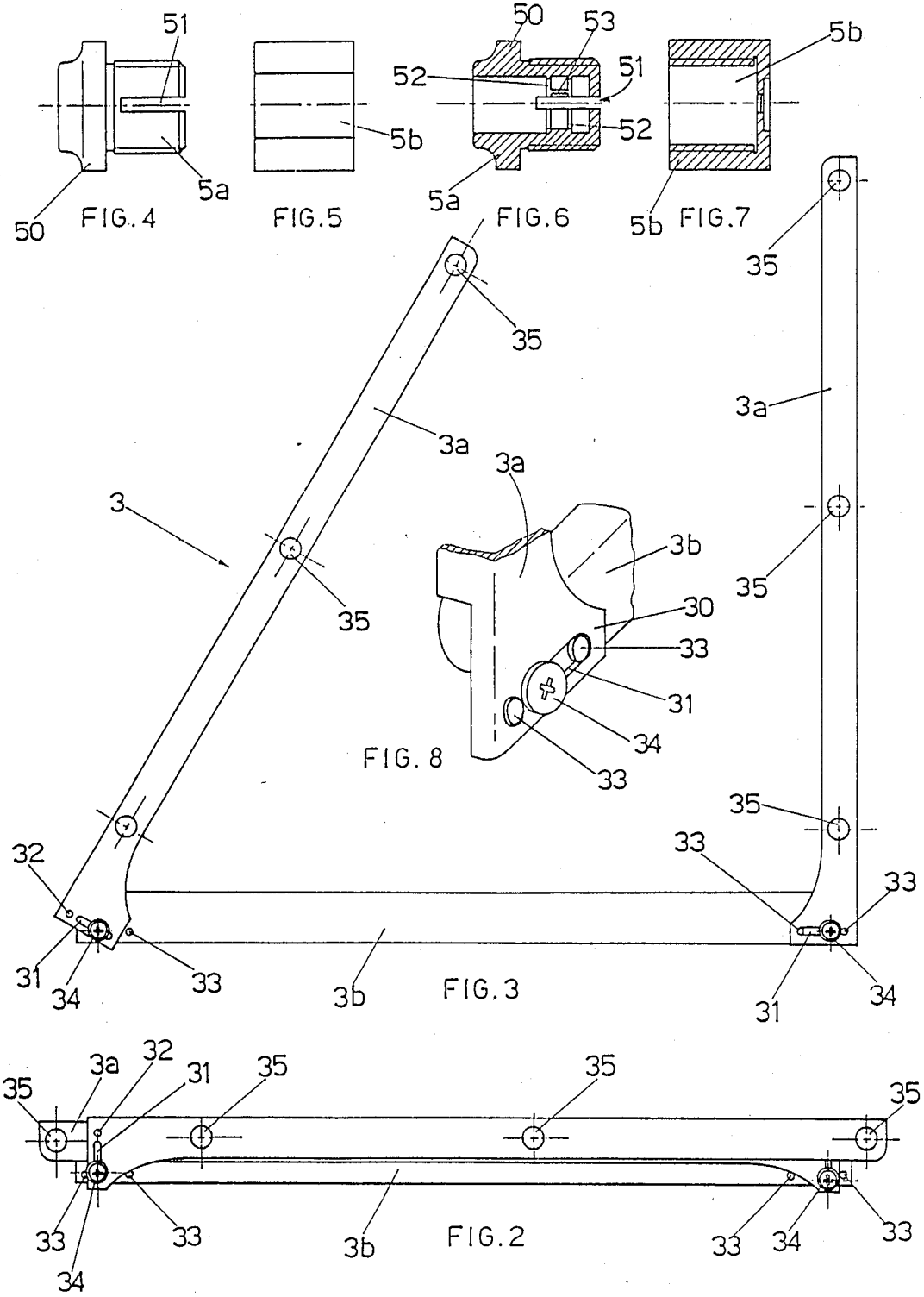
FIG. 2 shows one of the two lateral supporting frames in the closed position, i.e. where the uprights have been rotated downwards, so that they lie above and against the bottom counter-rail.
FIG. 3 shows the supporting frame of FIG. 2 with one of the two uprights half-opened, while the other upright rests in the vertical position.
FIGS. 4 and 5 are, respectively, two views of the screw and nut used to secure the trays to the lateral supporting frames.
FIGS. 6 and 7 are the two sections, on an axial plane, of FIGS. 4 and 5 respectively.
FIG. 8 is an enlarged detail of an upright from the lateral supporting frames.

With reference to FIG. 8, it should be noted that each upright (3*a*) terminates in a foot (30) bearing a long horizontal slot (31) beside the outer end of which and aligned therewith there is a circular hole (32).

From the inward-facing wall of the counter-rail (3*b*), at either end thereof, protrude two pins (33), made by means of semi-perforation, the distance therebetween being equal to that between the aforesaid hole (32) and an imaginary hole situated at the innermost end of the aforementioned slot (31).

When, during opening or closing, each upright (3*a*) is rotated with respect to the counter-rail (3*b*), the screws (34) that anchor the upright to the counter-rail are loosened and may slide within said slot (31); likewise, the pins (33) disengage from their respective hole (32) and slot (31) (see left upright in FIG. 3); once the upright (3*a*) has reached the vertical position, the anchoring screw is blocked by the end of the slot (31), and when tightened, automatically causes the pair of pins (33) to settle inside the hole (32) and the slot (31); thus, by simply acting upon the only securing screw (34) it is possible to obtain a perfectly reliable and stable connection, wherein the pieces lock into one another, between the uprights (3*a*) and the counter-rail (3*b*).

With reference to FIGS. 4,5,6, and 7, we will now examine the structure of the attachment (5) used to anchor the trays (4) to the uprights (3*a*) of the supporting frames (3).

It is composed of a hollow screw (5*a*) with a circular flange (50) designed to block against the internal part of the upright(3*a*) when the screw (5*a*) is inserted from the inner side of the upright towards the outer side, through one of the holes (35) provided on the uprights (3*a*).

The threaded portion possesses a slit (51) along its diameter that cuts sufficiently deeply into the axis of the screw to endow the two semi-cylindrical shells of said screw (5*a*), separated by the abovementioned slit (51), with a degree of elasticity.

On the inside of said hollow screw (5*a*), near the end, there are a number of circular ribs (52),designed to prevent extraction from the screw, between which there are a number of longitudinal ribs (53), their purpose being to prevent rotation.

As previously mentioned, said screws (5*a*) are designed to be pushed as far as they wi go over the four ends of the rounded metal crosspieces (4*a*) that go to make up the transversal edges of the trays or surfaces in the form of grilles; after which, the threaded portion of each hollow screw (5*a*) is inserted, from the inside towards the outside, through the holes (35) in the uprights (3*a*) of the lateral frames (3), as far as the aforementioned flange (50)will allow it to go.

Final blocking is achieved by putting an equal number of nuts (5*b*) onto the screws (5*a*); the former, when tightened, lie against the external walls of the uprights (3*a*).

It should be emphasised that the thread of the nut (5*b*) is slightly conical, so that, as it is screwed onto the screw (5*a*), the two semi-cylindrical shells of said screw are progressively and gradually pressed together around the end of the rounded piece of metal (4*a*), around which they clamp and remain securely blocked, aided by circular anti-extraction ribs (52) and the longitudinal antirotation ribs (53).

The invention claimed is:

1. A slidable carriage made of modular components that may be used to construct carriages of differing widths comprising:

a pair of guiding tracks each having a first end and a second end, means for anchoring each track to a surface;

a pair of counter rails, each having means for slidably engaging and cooperating with the respective guiding tracks, each counter rail further having a first end and a second end;

two pairs of upright supporting members, each pair having a first member and a second member, each upright supporting member having an upper end and a lower end, the lower end of each first upright supporting member being pivotally attached near the first end of the respective counter rail and the lower end of each second upright supporting member being pivotally attached near the second end of the respective counter rail such that when the supporting members are in an upright position, the counter rail and the upright supporting members may form a U-shaped frame;

a tray, and means for removably mounting the tray on the upper ends of the pairs of upright supporting members, such that when the tray is removed, the upright supporting members, may be folded downwardly towards one another about the pivot substantially 90° so that the supporting members may lie over and against the counter rail, for compact storage and shipment;

wherein the means for removably mounting the tray on the upright supporting member comprises an opening near the upper end of each upright supporting member, the tray having round transverse edges, the edges having ends thereon;

four screws each having a threaded body and a central bore therethrough, each screw being received on the respective ends of the edge of the tray, each screw further cooperating with and being received by the respective openings in the upright supporting members such that the tray is supported thereon;

each screw further having a slit therein to form two semi-cylindrical portions of the body, the two portions having a degree of elasticity;

the central bore of each screw further having a plurality of circular ribs thereabout to prevent removal of each screw from the tray;

the circular ribs further having longitudinal ribs therebetween to prevent rotation of each screw; and each nut further having conical threads therein such that when each nut engages the respective screw, the semi-cylindrical portions of the body of each screw are pressed against the ends of the edges of the tray to secure each screw thereto and such that the circular ribs and longitudinal ribs restrict movement of each screw.

2. A slidable carriage for use with kitchen units made of modular components that may be used to construct a carriage having a given width comprising:

a pair of guiding tracks each having a length, a first end and a second end, means for anchoring each track to a surface;

a pair of counter rails, each having means for slidably engaging and cooperating with the entire length of the respective guiding track, each counter rail further having a first end and a second end;

two pairs of upright supporting members, each pair having a first member and a second member, each upright supporting member having an upper end and a lower end, the lower end of each first upright supporting member being pivotally attached at the first end of the respective counter rail and the lower end of each second upright supporting member being pivotally attached at the second end of the respective counter rail such that each supporting member is independently pivoted about the respective counter rails and the supporting members may be placed in an upright position, relative to the counter rail to form a foldable upright U-shaped frame; and a tray, and means for removably mounting the tray on the upper ends of the pairs of upright supporting members, such that when the tray is removed, the upright supporting members, may be folded downwardly towards one another about the pivot substantially 90° so that the supporting members may lie over and against the counter rail, for compact storage and shipment.

3. The carriage of claim 2, wherein the means for engaging each counter rail with the respective guiding track comprises a pair of roller bearings.

4. The carriage of claim 3, wherein a one roller bearing is mounted on the counter rail and another roller bearing is mounted on the guiding track.

5. The carriage of claim 2, wherein the pair of guiding tracks are independent of each other, having no transverse connection therebetween such that the tracks may be spaced apart and mounted on the surface; the tray having a width, the space between the tracks being determined by the width of the tray and when the counter rails and upright supporting members attached thereto are engaged in the respective tracks, and the upright supporting members are pivoted to the upright position, the independent U-shaped frames are formed on which the tray may be mounted.

6. The carriage of claim 2, further comprising:

the lower end of each supporting member having an elongated slot therein and a circular hole therein opposite to and, aligned with the slot, a screw received in the slot and connected to the counter rail so that the upright supporting member may pivot thereabout; and the first end and the second end of the counter rail each having a pair of spaced-apart pins protruding therefrom, the distance between the pins being equal to distance between the hole in the lower end of the supporting member and an imaginary hole located at the opposite end of the slot in the lower end of the supporting member such that when the screw is loosened, the upright supporting member may be pivoted to the fully upright position and the pins engage the slot and the opening and when the screw is tightened, the pins lock the upright supporting member to prevent movement.

7. A slidable carriage for use with kitchen units made of modular components that may be used to construct a carriage having a given width comprising:

a pair of guiding tracks each having a length, a first end and a second end, means for anchoring each track to a surface;

a pair of counter rails, each having means for slidably engaging and cooperating with the entire length of the respective guiding tracks, each counter rail further having a first end and a second end;

two pairs of upright supporting members, each pair having a first member and a second member, each upright supporting member having an upper end and a lower end, the lower end of each first upright supporting member being pivotally attached at the first end of the respective counter rail and the lower end of each second upright supporting member being pivotally attached at the second end of the respective counter rail such that each supporting member is independently pivoted about the respective counter rails and the supporting members may be placed in an upright position, relative to the counter rail to form a foldable U-shaped frame;

a tray, and means for removably mounting the tray on the upper ends of the pairs of upright supporting members, such that when the tray is removed, the upright supporting members, may be folded downwardly towards one another about the pivot substantially 90° so that the supporting members may lie over and against the counter rail, for compact storage and shipment;

wherein the means for engaging each counter rail with the respective guiding track comprises a pair of roller bearings;

wherein the pair of guiding tracks are independent of each other, having no transverse connection therebetween such that the tracks may be spaced apart and mounted on a surface, the tray having a width, the space between the tracks being determined by the width of the tray, and when each counter rail and upright supporting members attached thereto is engaged in the respective tracks, and the upright supporting members are pivoted to the upright position, the independent U-shaped frames are formed on which the tray may be mounted;

further comprising the lower end of each supporting member having an elongated slot therein and a circular hole therein opposite to and, aligned with the slot, a screw received in the slot and connected to the counter rail so that the upright supporting member may pivot thereabout; and the first end and the second end of the counter rail each having a pair of spaced-apart pins protruding therefrom, the distance between the pins being equal to distance between the hole in the lower end of the supporting member and an imaginary hole located at the opposite end of the slot in the lower end of the supporting member such that when the screw is loosened, the upright supporting member may be pivoted to the fully upright position and the pins engage the slot and the opening and when the screw is tightened, the pins lock the upright supporting member to prevent movement.

* * * * *